US008882559B2

(12) United States Patent
Fessenmaier

(10) Patent No.: US 8,882,559 B2
(45) Date of Patent: Nov. 11, 2014

(54) MIXED REALITY REMOTE CONTROL TOY AND METHODS THERFOR

(76) Inventor: Bergen E. Fessenmaier, Aliso Viejo, CA (US)

( * ) Notice: Subject to any disclaimer, the term of this patent is extended or adjusted under 35 U.S.C. 154(b) by 137 days.

(21) Appl. No.: 13/573,183

(22) Filed: Aug. 27, 2012

(65) Prior Publication Data

US 2014/0057527 A1 Feb. 27, 2014

(51) Int. Cl.
*A63H 30/04* (2006.01)

(52) U.S. Cl.
USPC ..... 446/454; 446/321

(58) Field of Classification Search
CPC ..... A63H 29/22; A63H 30/04; G08C 17/02; G08C 2201/91
USPC ..... 446/454
See application file for complete search history.

(56) References Cited

U.S. PATENT DOCUMENTS

| | | | | |
|---|---|---|---|---|
| 6,568,983 | B1 * | 5/2003 | Peters | 446/175 |
| 2002/0111117 | A1 * | 8/2002 | Ho et al. | 446/456 |
| 2003/0232649 | A1 * | 12/2003 | Gizis et al. | 463/40 |
| 2005/0186884 | A1 * | 8/2005 | Evans | 446/456 |
| 2006/0223637 | A1 * | 10/2006 | Rosenberg | 463/47 |
| 2009/0284553 | A1 * | 11/2009 | Seydoux | 345/649 |
| 2010/0178982 | A1 * | 7/2010 | Ehrman | 463/37 |
| 2013/0109272 | A1 * | 5/2013 | Rindlisbacher | 446/454 |

* cited by examiner

*Primary Examiner* — Tramar Harper

(57) ABSTRACT

A tablet computer using motion sensors controls a remote controlled toy. A camera of the tablet computer acquires an image of the toy and the environment in which the toy is played with. The tablet computer then substitutes the image of the environment with a virtual environment, wherein the virtual environment is continuously adjusted using a parameter of the environment. For example, where the environment is a room with a wall and a doorway, the virtual environment may be a battlefield having a forest in place of the wall and a road through the forest in place of the doorway.

20 Claims, 1 Drawing Sheet

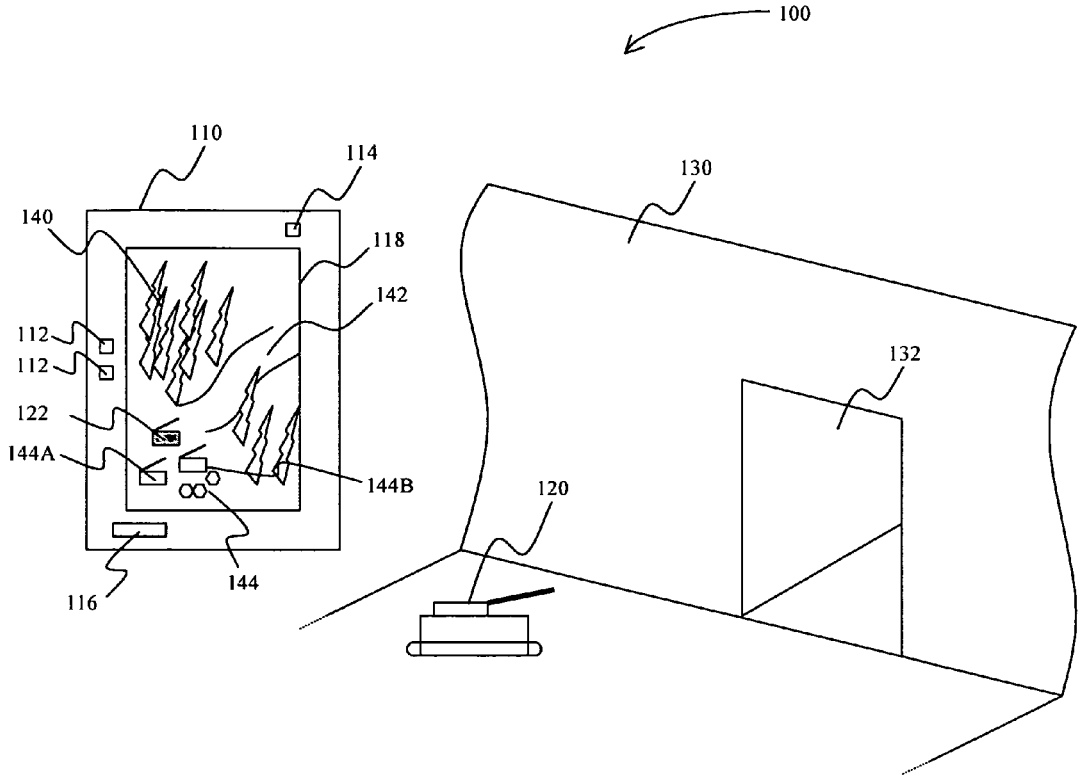
100
110
114
130
140
118
142
112
112
132
122
144A
144B
120
116
144

MIXED REALITY REMOTE CONTROL TOY AND METHODS THERFOR

FIELD OF THE INVENTION

The field of the invention is systems and methods for remote controlled toys, especially those in which a tablet computer with display is employed as the controller of the remote control toy.

BACKGROUND OF THE INVENTION

Remote control toys, and especially remote controlled planes and cars, have enjoyed considerable popularity for numerous years. However, significant practice is often needed to operate such toys as the manual controls are typically less than intuitive. More recently, some remote controlled toys have entered the market in which the toy is controlled via one or more motion sensors and/or display of an iPad (e.g., AR quadricopter, Parrot Inc.). Additionally, the remote controlled toy may include a video camera that provides a video feed back to the display of the tablet computer. While such control mechanism and user interaction is improved to at least some degree, various drawbacks still remain. Most significantly, control of the toy may be confusing as the user sees both, the video camera feedback from the toy on the iPad and the actual toy in its environment.

To improve visual gaming experience in tablet devices without remote control toys, various virtual targets or guns may be simulated and overlaid onto a displayed environment on a screen of a tablet device where the camera of the device provides the signals for display of the environment. Using touch sensitive controls and a virtual gun on the display, the virtual targets can then be attacked on the screen in a realistic environment captured by the camera. In another example of non-toy mixed reality control, a camera of a tablet device captures information of a real object that is also displayed on the screen of the tablet device. Image analysis can then be used to provide remote control/operation of the visually acquired object. For example, a user can control transactions (e.g., product selection, payment, etc.) of a vending machine by performing the transactions in a series of simulated operations on the screen. As will be readily appreciated, such remote control often requires substantial processing and dedicated equipment and has to the best of the inventor's knowledge not been implemented with a remote controlled toy.

In still further well-known methods of image manipulation without remote controlled toys, a uniform background of a digitally acquired image can be substituted with a video stream by substituting the background color (typically a green screen) with the video stream. While such image manipulation is well established, substitution of background color does not provide a remote control.

Therefore, even though many systems and methods for image manipulation and toy control are known in the art, numerous drawbacks remain. Consequently, there is still a need to provide improved methods and systems for remote controlled toys, especially in combination with a mixed reality remote control.

SUMMARY OF THE INVENTION

The present inventive subject matter is drawn to improved systems, kits, and methods of remote control toys in which a tablet computer is employed as a remote control and display unit in which a composite image of the remote controlled toy and a simulated environment is displayed, and in which an acquired environmental parameter is used to adapt or modify the simulated environment.

In one preferred aspect of the inventive subject matter, a method of providing display information for a remote controlled toy includes the steps of (a) configuring a tablet computer having a plurality of motion sensors to control a remote control toy in an environment, (b) configuring the tablet computer to acquire an image of the toy and the environment while the toy is being controlled by the tablet computer, (c) configuring the tablet computer to process the acquired image by replacing the image of the acquired environment with a virtual environment, and by producing a composite output image that is formed from the acquired image of the toy and the virtual environment, and (d) configuring the tablet computer to adjust the virtual environment in the output image using an acquired parameter from the acquired environment. Consequently, toy kits are especially contemplated that include the tablet computer and/or the remote controlled toy. Moreover, it is also noted that software applications and non-transitory storage media storing the software applications (or components thereof) are contemplated that allow operation of the toy as described above.

Most preferably, the remote controlled toy is a flying toy, a boat, a car, or a tank, wherein the remote controlled toy has a (preferably) limited set of predefined colors. It is still further preferred that the environment is an indoor environment having a plurality of walls, a doorway, and a floor, and wherein at least one of the walls has a vertical and/or horizontal border. Likewise, it is preferred that the virtual environment is a simulated landscape, a simulated outer space, or a simulated underwater environment. Additionally, it is preferred that the acquired parameter is a static object in the environment (e.g., a border between a wall and a floor in the environment, a doorway in a wall or at least formed in part by a wall). Where desired, it is contemplated that the tablet computer further produces an audio output, is configured to process the acquired image of the toy to produce a simulated gun fire or rockets originating from the acquired image of the toy, and/or is configured to use at least one of the acquired parameter and the virtual environment to modify remote controlling of the remote control toy.

Various features, aspects, and embodiments will become more apparent from the following description of exemplary systems and methods, along with the accompanying drawing.

BRIEF DESCRIPTION OF THE DRAWING

FIG. 1 is a schematic of an exemplary remote controlled toy kit according to the inventive subject matter.

DETAILED DESCRIPTION

The inventor has discovered that a remote control toy can be controlled with a tablet computer (e.g., iPad) in an interactive and entertaining manner in which motion of the tablet controls the remote control toy, and in which the camera portion of the tablet computer acquires an image of the toy in its actual environment. While playing, the tablet computer substitutes the background (i.e., non-toy image portion) of the acquired image with a virtual image (e.g., battlefield, outer space, etc.), wherein the virtual image is continuously adjusted using at least one acquired parameter (e.g., wall, doorway, etc.) of the actual environment. Thus, it should be appreciated that the remote controlled toy can be displayed on the display of the tablet computer in any desired environment while providing actual spatial constraint information to the user while viewing the virtual environment. For example, where the user plays with a remote controlled tank toy in a room that has a wall and a doorway, the virtual environment may be a battlefield having a forest in place of the wall and a road through the forest in place of the doorway. Thus, actual physical constraints are translated into virtual constraints that will allow or disallow passage of the remote controlled toy in the simulated environment.

In one exemplary aspect of the inventive subject matter, a toy kit comprises a remote controlled toy and a tablet computer as a controller for the toy. Most preferably, the tablet computer uses one or more motion sensors and associated software to so allow for remote controlling of the remote control toy in any environment (e.g., indoors, outdoors, etc). It is still further generally preferred that the tablet computer has at least one camera that can acquire an image of the toy while the toy is controlled in the environment. Most typically, the tablet computer executes software that allows the tablet computer to process the acquired image, to replace the image of the acquired environment with a virtual environment, and to produce a composite output image from the acquired image of the toy and the virtual environment. In especially preferred aspects of the inventive subject matter, the software allows the tablet computer to adjust the virtual environment in the output image using an acquired parameter from the acquired environment.

Therefore, and viewed from a different perspective it should be appreciated that display information for a remote controlled toy can be provided to a player by operating software on a tablet computer that has one or more motion sensors that allow for remote controlling of a remote control toy in an environment. In especially preferred aspects, the tablet computer is programmed to acquire an image of the toy and the environment, while the toy is being controlled by the tablet computer. The acquired image is then processed by replacing the image of the acquired environment with a virtual environment, by producing a composite output image that is formed from the acquired image of the toy and the virtual environment, and by adjusting the virtual environment in the output image using an acquired parameter from the acquired environment, typically while the toy is being controlled by the tablet computer.

Of course, it should be appreciated that the composite image may also be produced by combination of the virtual environment with a virtual representation of the remote controlled toy. Moreover, it is noted that one or more additional simulated elements may be included in the composite image to further enhance the gaming experience. For example, virtual team mates (e.g., wingman, second tank, etc.) or virtual enemies (e.g., airplane, rocket, etc.) may be provided that may cooperatively or adversely interact with the displayed toy.

FIG. 1 exemplarily illustrates a remote control toy kit 100 in which tablet computer 110 controls operation of remote controlled toy tank 120. The toy moves in a room having a wall 130 and a doorway 132 within the wall. Tablet computer 110 has one or more motion sensors 112 that are used to control the direction of the toy and cameral 114 to acquire an image while controlling the motion of the toy. Processor 116 processes image data such that on the display 118 of the tablet computer, the wall acquired by the camera is substituted by a forest 140, and the doorway is substituted by a roadway 142. The remaining background portion is substituted by desert landscape 144 having additional simulated enemy tanks 144A and 144B. Processor 116 further processes image data such that the acquired image of the toy 122 is combined with the virtual environment to so produce a composite image. As the player and the toy move through the actual environment, the processor continuously processes the virtual image portion on the basis of the acquired parameters of the actual environment. Moreover, the simulated enemy tanks can interact (e.g., shot at, and even disable) with the displayed toy, wherein such interaction may further take into account one or more acquired parameters of the actual environment.

With respect to the toy, it is contemplated that the toy can be any toy suitable for remote control, and that the type and size of the toy is not limiting to the inventive subject matter presented herein. For example, contemplated toys include wheeled toys (e.g., race cars, mars rovers, monster trucks), toys with tracks (e.g., tanks, spy or reconnaissance robots, etc.), flying toys (e.g., helicopter, quad copter, rocket, etc.), and swimming/floating or even submerged toys (e.g., police boat, speed boat, U-boat, etc.). To enhance recognition of the toy by the image processing software, the toy may be colored in a single color, single color type, color pattern, and/or in a limited set of predefined colors.

Suitable toys may further include sensors to acquire additional information from other toys and/or the environment, and sensors will typically include infrared sensors, ultrasound sensors, RF sensors, light-sensitive sensors, acoustic sensors, mechanical sensors, etc. Likewise, contemplated toys will include one or more additional (typically game-related) components, including light emitters, sound emitters, and mechanical implements (e.g., gun turrets, grabbing arms, etc.) to enhance game experience. In further preferred aspects, it is noted that the toys contemplated herein will also include one or more devices that will allow for interaction with other toys. For example, such devices will include optical (e.g., IR, UV/VIS, etc.) or RF-based devices (e.g. Bluetooth, Wifi, 44.1 kHz, etc.) to provide and/or exchange signals.

The remote control may include numerous basic functions, including those controlling left/right movement, up/down movement, and all combinations thereof. Furthermore, it should be noted that remote control may include additional functions that are specific to the toy and suitable functions include those to control light and/or sound effects, operation of LED or laser diode guns, launching of rockets or bombs, movement of components of the toy (e.g., gun turret, robotic or grabbing arm, periscope, etc.). Most preferably, the movement is effected by operation of one or more servo or stepper motors in a manner as is well known in the art. In especially preferred aspects of the inventive subject matter, the signal transmission from the tablet computer to the toy remote control will be based on or made from components already well known in the art. Modulation and demodulation of the transmitted signals will be performed as is well known on the art. Therefore, especially preferred remote controls are WiFi- or Bluetooth-based remote controls, IR-based remote controls, and/or UHF/VHF-based remote controls. Thus, the receiver on the toy may vary accordingly and the appropriate choice of the receiver will be dictated by the choice of the transmitter. While components for the WiFi- or Bluetooth-based remote controls are already present in most tablet computers, it is also contemplated that additional (and most typically external) components may be used in conjunction with the tablet computer. For example, an IR or UHF/VHF-based transmitter may be electronically coupled to a port (e.g., USB port) of the tablet computer.

With respect to the software component(s) of contemplated devices and methods, it should be noted that the software is typically downloaded as an application from a non-transitory data storage device of a remote source (e.g., App store) but may also be provided on non-transitory data storage device (e.g., flash memory, CD, DVD, etc) that is used by the user playing with the remote control toy. Alternatively, software may also be resident a non-transitory data storage element in the remote control toy, which is then relayed to the table computer. While it is generally preferred that the software is stored and executed on the table computer, it should also be recognized that at least portions or modules of the software may be stored and/or executed on board the remote controlled toy.

Likewise, it should be noted that additional tablet computers may be configured such that the remote control toy may be operated in a multi-player environment. For example, while the remote control toy is controlled from a first tablet computer essentially as described above, a second tablet computer may be configured to allow interaction with the software of the first tablet computer such that the second tablet computer can control the remote control toy and/or control a virtual object in the simulated environment on the first tablet computer. Thus, a second player can use a second tablet computer to cooperatively and/or adversely interact with the game play on the first tablet computer. Most preferably, the second tablet computer will receive appropriate information from the first tablet computer to so allow for coordinated display of the simulated environment on the first tablet computer. It is also noted that the second tablet computer may receive information from the remote controlled toy. Thus, the software of contemplated toys and methods presented herein may be exclusively located on a single tablet computer or may be distributed (e.g., as functional modules) over at least two tablet computers (and also the remote control toy). Where portions of the software are distributed, it should be noted that the distributed portions may be functional duplicates of portions operating on another tablet computer, or stand-alone modules. Consequently, it is contemplated that data transfer between the first tablet computer and additional tablet computers may be performed in uni-, bi-, and multidirectional manner.

Software components for the remote control toys and methods presented herein are preferably (but not necessarily) configured as multiple functional modules that allow for interactive or scheduled data transfer as needed. Moreover, where the tablet computer has already software components suitable for use herein, it is preferred that such components are employed in conjunction with contemplated methods and toys. For example, image acquisition will typically use already present components of the tablet computer and all known manners of image acquisition are deemed suitable for use herein. Thus, the image acquisition module will be at least in part provided by the tablet computer's own hard- and software components. Of course, it should be noted that the term 'image acquisition' and 'acquired image' applies to both still images as well as video content/streams. Consequently, suitable image formats include all known compressed and raw image/video formats.

With respect to image processing it is generally contemplated that all known manners of image processing are suitable that allow processing of an acquired image into a processed image in substantially real-time (i.e., with a delay of less than 1 s, more typically less than 300 ms, and most typically less than 100 ms). Image processing according to the inventive subject matter is used to isolate an image portion representative of the toy from the non-toy image portion (typically background), and to replace the non-toy image portion with a simulated background. Most typically, the simulated background is generated using at least one environmental parameter of the originally acquired image.

In a first aspect of the inventive subject matter, there are numerous manners of background subtraction known in the art, and all of the known manners are deemed suitable for use herein. For example, the image processing module may be trained to recognize the toy using a training algorithm. Alternatively, the toy may be colored with a set of predefined colors that are recognized and isolated by the image processing module, or the toy may be recognized and isolated using contrast mapping filters and a library of recognized toy shapes. In still further known manners, the toy may be recognized by its movement relative to a non-moving background. Still further, it is noted that the toy position may be acquired and then substituted with a graphical representation of the toy at the position and scale as acquired. Of course, all reasonable combinations of such known methods are also deemed suitable for use herein.

Once isolated, the so acquired image of the toy can be enhanced (e.g., for contrast, color, shape, etc.) or used directly in the production of the composite image. While it is generally preferred that the scale and position of the acquired image of the toy is retained in the composite image, it is also contemplated that the scale and/or position may be changed. In further especially contemplated aspects, the acquired image of the toy may be processed according to certain events in the game. For example, where the toy is a tank and the event is the tank hitting a landmine, the acquired image of the tank may be altered to reflect damage. In another example, where the acquired image of the toy is an airplane and where the airplane is hit by a missile launched from another players second tablet computer, the acquired image of the plane may be processed to depict smoke. Additionally, and as already described above, a direct hit may result in at least partial incapacitation or loss of control of the remote controlled toy.

With respect to a second aspect of image processing it is contemplated that the non-toy portion (the environment in which the toy is being controlled) of the acquired image is analyzed to identify an acquired environmental parameter (typically spatial parameter) of the acquired environment. As noted before, it is typically preferred that such analysis is performed in real-time, and that such image analysis will use algorithms well known in the art. For example, image analysis for continuous and/or discontinuous straight lines or continuous and/or discontinuous color/contrast lines can be used to identify corners, wall-ceiling and wall-floor transitions, etc. Therefore, acquired parameters of the acquired environment will typically include size, position, and/or geometry of spatial boundaries (e.g., walls, floors, ceilings, doorways, staircase, doors, etc.), interconnection or relative positions of spatial boundaries (acquired parameters), etc. For example, particularly suitable image analysis software may use Simultaneous Localization and Mapping (SLAM) algorithms. In further contemplated aspects, image processing may further include determination of the spatial position of the toy relative to at least one of the acquired environmental parameters. Thus, it should be appreciated that image processing according to the inventive subject matter will provide a combination of an image portion of the remote controlled toy together with information of one or more environmental parameters.

With respect to a third aspect of image processing it is contemplated that a virtual background generation module generates a virtual background using at least one of the environmental parameters using methods well known in the art. Such module may operate by assembling multiple image elements from a library according to the position and extent of the environmental parameters. Alternatively, image elements may also be generated using a random generator that then provides the image elements for assembly. Likewise, preexisting image information may also be distorted (e.g. folded using angle functions, or bent/curved using stretch functions) according to the environmental parameter. In yet another aspect of the inventive subject matter, certain image elements may also be selected to match at least one of the environmental parameters. Most typically, where image element libraries are employed, it is contemplated that such libraries contain a plurality of elements that are representative of certain environments (e.g., outer space, jungle, desert, urban environment, etc.)

For example, where the library is used to simulate a jungle environment, and where an environmental parameter is a wall and a doorway, the background generation module may assemble an area of thick foliage in place of the wall and a pathway in place of the doorway. The remaining background is populated with a loose collection of hanging vines and blurred swatches of green-brown colored background elements. Scaling of the elements to provide proper depth perception is performed using relative positional information and/or scaling information from the image elements. Consequently, it should be recognized that using image processing according to the inventive subject matter will provide an image that is composed of a real (acquired) image portion and a simulated image portion, wherein the simulated image portion is generated using one or more extracted environmental parameters of the acquired background (which is subsequently replaced by the simulated background).

Where desired, additional components may be added into the simulated background as either static, preprogrammed, or random objects, or added under the control of a second user (most typically a second player). Most typically, additional components are preferably (but not necessarily) cooperative or adversarial objects that most preferably interact with the toy on the display. Such interaction will most preferably also interact with at least one aspect of the control of the remote control toy. For example, where the additional component is a simulated tank, and where the remote control toy is a tank, the simulated tank may shoot at the remote control tank (e.g., in a preprogrammed manner or under control of a second player via a second remote), wherein such interaction is entirely simulated on the display of the tablet computer. Once the simulated tank has successfully 'shot' the remote control toy, at least one function of the remote control may be temporarily disrupted, partially disabled, or otherwise negatively affected. In another example, where the additional component is a simulated helicopter and where the remote control toy is a toy helicopter, one or more actions of the simulated helicopter may be at least partially controlled by the tablet computer (e.g., via preprogrammed functions, including tagging/targeting of objects in the simulated environment attack by the remote control toy).

Where the simulated object is at least partially controlled by a second player, it is typically preferred that the second player will have a smart phone or tablet computer that is configured to display the same composite output image that is formed from the acquired image of the toy and the virtual environment. Such composite output can be directly copied to the smart phone or tablet computer of the second player (e.g., via WiFi or Bluetooth) or generated from corresponding data that are transferred from the remote control tablet computer to the smart phone or tablet computer of the second player. Likewise, information (including speed, position, action, etc.) for the simulated object may be transferred to the remote control tablet computer as described above. Thus, the second smart phone or tablet computer may be configured substantially as the remote control tablet computer, or may be configured as a non-remote control display unit.

Therefore, it should be appreciated that the systems and methods according to the inventive subject matter will advantageously allow for interactive play using a single remote control toy, where the interaction is at least partially simulated and/or displayed on the tablet computer. Moreover, such interaction preferably also affects at least one function of the remote control.

Thus, specific embodiments and applications for mixed reality video games and methods therefore have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Furthermore, where a definition or use of a term in a reference, which is incorporated by reference herein is inconsistent or contrary to the definition of that term provided herein, the definition of that term provided herein applies and the definition of that term in the reference does not apply.

What is claimed is:

1. A method of providing display information for a remote controlled toy, comprising:

configuring a tablet computer having a camera and a plurality of motion sensors to allow for remote controlling of a remote control toy in an environment using the motion sensors;

configuring the tablet computer to use the camera of the tablet computer to acquire an image that includes an image portion comprising the toy and an image portion of the environment while the toy is being controlled by a user moving the tablet computer, wherein the environment in the image portion of the environment is selected from the group consisting of a wall, a floor, a ceiling, a staircase, an opening in a wall, and a doorway;

configuring the tablet computer to process the acquired image to (1) acquire from the image portion of the environment a spatial parameter representative of spatial constraint information of the actual environment, (2) generate an adjusted virtual environment using the acquired parameter from the image portion of the environment, wherein the adjusted virtual environment is generated based on the spatial parameter representative of spatial constraint information of the actual environment;

(3) replace the image portion of the environment with the adjusted virtual environment;

(4) produce a composite output image that is formed from the image portion of the toy and the adjusted virtual environment such that the image portion of the environment in the composite output image is replaced by the adjusted virtual environment and such that the composite output image displays the image portion comprising the toy within the adjusted virtual environment; and displaying the composite output image on a display of the tablet computer.

2. The method of claim 1 wherein the remote controlled toy is a flying toy, a boat, a car, or a tank.

3. The method of claim 1 wherein the remote controlled toy has less than six different colors.

4. The method of claim 1 wherein the environment is an indoor environment having a plurality of walls and a floor, and wherein at least one of the walls has a vertical border.

5. The method of claim 1 wherein the adjusted virtual environment is a simulated landscape, a simulated outer space, or a simulated underwater environment.

6. The method of claim 1 wherein the acquired parameter is a static object in the environment.

7. The method of claim 1 wherein the acquired parameter is a border between a wall and a floor in the environment.

8. The method of claim 1 wherein the tablet computer further produces an audio output.

9. The method of claim 1 further comprising a step of processing the acquired image of the toy to produce a simulated gun fire or rockets originating from the acquired image of the toy.

10. The method of claim 1 further comprising a step of using at least one of the acquired parameter and the adjusted virtual environment to modify remote controlling of the remote control toy.

11. A game kit comprising:

a tablet computer having a camera, and a remote controlled toy;

wherein the tablet computer is configured to use a plurality of motion sensors for remote controlling of the remote control toy in an environment;

wherein the camera of the tablet computer is configured to acquire an image that includes an image portion comprising the toy and an image portion of the environment while the toy is being controlled by a user moving the tablet computer;

wherein the environment in the image portion of the environment is selected from the group consisting of a wall, a floor, a ceiling, a staircase, an opening in a wall, and a doorway;

wherein the tablet computer is further configured to process the acquired image to (1) acquire from the image portion of the environment a spatial parameter representative of spatial constraint information of the actual environment, (2) generate an adjusted virtual environment using the acquired parameter from the image portion of the environment, wherein the adjusted virtual environment is generated based on the spatial parameter representative of spatial constraint information of the actual environment;

(3) replace the image portion of the environment with the adjusted virtual environment;

(4) produce a composite output image that is formed from the image portion of the toy and the adjusted virtual environment such that the image portion of the environment in the composite output image is replaced by the adjusted virtual environment and such that the composite output image displays the image portion comprising the toy within the adjusted virtual environment; and wherein the tablet computer is further configured to display the composite output image on a display of the tablet computer.

12. The game kit of claim 11 wherein the remote controlled toy is a flying toy, a boat, a car, or a tank.

13. The game kit of claim 11 wherein the remote controlled toy has a limited set of predefined colors.

14. The game kit of claim 11 wherein the environment is an indoor environment having a plurality of walls and a floor, and wherein at least one of the walls has a vertical border.

15. The game kit of claim 11 wherein the adjusted virtual environment is a simulated landscape, a simulated outer space, or a simulated underwater environment.

16. The game kit of claim 11 wherein the acquired parameter is a static object in the environment.

17. The game kit of claim 11 wherein the acquired parameter is a border between a wall and a floor in the environment.

18. The game kit of claim 11 wherein the tablet computer is further configured to produce an audio output.

19. The game kit of claim 11 wherein the tablet computer is further configured to process the acquired image of the toy to thereby produce a simulated gun fire or rockets originating from the acquired image of the toy.

20. The game kit of claim 11 wherein the tablet computer is further configured to use at least one of the acquired parameter and the adjusted virtual environment to thereby modify remote controlling of the remote control toy.

* * * * *